US008469362B1

(12) United States Patent
Rosenberg

(10) Patent No.: US 8,469,362 B1
(45) Date of Patent: Jun. 25, 2013

(54) WAGERING CARD GAME

(76) Inventor: Sander Roy Rosenberg, Las Vegas, NV (US)

( * ) Notice: Subject to any disclaimer, the term of this patent is extended or adjusted under 35 U.S.C. 154(b) by 29 days.

(21) Appl. No.: 13/506,431

(22) Filed: Apr. 17, 2012

Related U.S. Application Data

(63) Continuation-in-part of application No. 13/200,954, filed on Oct. 4, 2011.

(51) Int. Cl.
*A63F 1/00* (2006.01)

(52) U.S. Cl.
USPC ..... 273/292

(58) Field of Classification Search
USPC ..... 273/292
See application file for complete search history.

(56) References Cited

U.S. PATENT DOCUMENTS

| | | | | |
|---|---|---|---|---|
| 5,324,041 | A * | 6/1994 | Boylan et al. | 273/292 |
| 6,412,779 | B1 * | 7/2002 | Kenney | 273/292 |
| 8,113,936 | B2 | 2/2012 | Filipour et al. | |
| 8,118,655 | B1 | 2/2012 | Maksymec | |
| 2006/0151948 | A1 * | 7/2006 | McGanty et al. | 273/248 |

OTHER PUBLICATIONS

David Parlett, The Penguin Book of Card Games.
Tom Ainslie, Ainslies Complete Hoyle.
www.wizardofodds.com/chemindefer.
http://www.pagat.com/alpha.html Rules of Card Games: alphabetical index.
http://www.pagat.com/banking/ Card Games: Banking Games.
www.wizardofodds.com/craps.
http://www.thegamesforum.com/Faro.htm.

* cited by examiner

*Primary Examiner* — Michael Dennis

(57) ABSTRACT

Cards are used to create a wagering game that can be promoted as being a version of Russian Roulette. Regardless of how many bettors there are at a casino betting table, only two hands are dealt. Each bettor has the option of betting on either hand X or hand Y. A method for determining which hand is the winning hand is comprised of dealing alternately one card to hand X and one card to hand Y until one of the hands is dealt a predesignated losing card or a predesignated winning card. A method for regulating betting in a hand of cards is described. A method for enabling a casino to offer bettors multiple free bets without lowering the casino's average edge on the game is also described. Side bets are described. Multiple other features of the game are also described.

13 Claims, 6 Drawing Sheets

WAGERING CARD GAME

BACKGROUND

Prior Art

Real Russian Roulette, involving guns and bullets, is not suitable for play in a casino.

SUMMARY

Cards are used to create a wagering game. The object of this embodiment is to provide a wagering game that will appeal both to bettors and casinos.

In accordance with the stated object, a wagering card game that can be promoted as being a version of Russian Roulette is presented.

Real Russian Roulette, involving guns and bullets, has instant name recognition. A wagering card game with a title that includes the words Russian Roulette should generate curiosity amongst casinos and bettors. This curiosity can be an important first step in getting a new game looked at in a very competitive market.

To advance beyond curiosity and succeed on merit without necessarily depending on a Russian Roulette theme, this game includes multiple features designed to appeal to bettors and casinos.

Some of the features that are designed to appeal to bettors are:

Except for optional side bets, bettors have a 50% probability of winning each and every bet that they make.

Like sports betting and baccarat, bettors are offered two way betting.

Unlike blackjack, this game does not have ties that result in boring do-overs.

Hands in this game can have multiple rounds of betting with excitement and tension increasing in each round as the stakes go up in each round.

Bettors can be offered multiple free bets with no casino commission.

Some of the features that are designed to appeal to casinos are:

When multiple bettors are betting, this game can be played substantially faster than the popular casino game blackjack. Therefore, a casino can book substantially more bets per hour with this game than with blackjack.

The odds in this game do not change when a deck is partially full. Thus, card counters who know which cards are left in a partially full deck, cannot gain any advantage from knowing.

This game does not have any ties. Every bet is a winning bet or a losing bet. This further enables a casino to book more resolved bets per hour.

This game does not have a fixed casino edge. A casino has the option of choosing the edge that it wants to take in the form of taking a percentage commission on bettors winning bets.

A casino has the option of taking a commission on all winning bets made by bettors. A casino also has the option of taking a commission on only some of the winning bets made by bettors. If a casino chooses to take a commission on only some bets, this game enables the casino to offer bettors multiple free bets without lowering the casino's average edge.

DETAILED DESCRIPTION

Cards are used to create a wagering game that can be promoted as being a version of Russian Roulette.

The object of this embodiment is to present a wagering card game that will appeal to both bettors and casinos.

Cards can be dealt by a casino appointed dealer or by one of the bettors.

Regardless of how many bettors there are at a betting table, only two hands are dealt.

For convenience, I will refer to the two hands as hand X and hand Y. When this game is played in a casino and/or transmitted electronically, the two hands can be labeled something other than hand X and hand Y.

Each bettor has the option of betting on either hand X or hand Y.

This game is similar to baccarat in that regardless of the number of bettors, only two hands are dealt. However, this game is very different from baccarat because this game uses a very different method for determining which of the two hands is the winning hand.

The method used in this game for determining which hand is the winning hand is comprised of dealing alternately one card to hand X and one card to hand Y until one of the hands is dealt a predesignated losing card or a predesignated winning card.

If one of the hands is dealt a predesignated losing card, the other hand wins and no further cards are dealt.

If one of the hands is dealt a predesignated winning card, that hand wins and no further cards are dealt.

Hand X or hand Y can win after only one card has been dealt to one of the hands.

Predesignated losing cards and predesignated winning cards are not in the same deck. This game can be played with a deck that contains one or more predesignated losing cards. As an alternative, this game can be played with a deck that contains one or more predesignated winning cards. Each of the two alternatives is mathematically the same. The difference is that using a deck containing a predesignated losing card is more consistent with a Russian Roulette theme, which a casino may or may not want to emphasize. Thus, it is a casinos choice to decide between using a deck wherein the determining factor is a predesignated losing card or using a deck wherein the determining factor is a predesignated winning card.

As an alternative to using a Russian Roulette theme, this game can be played without any promotional theme, in the manner that blackjack and baccarat are played without any promotional theme.

Another alternative is using one of many possible promotional themes other than Russian Roulette. For instance, but not limited to, striking gold or finding buried treasure.

In this game, decks are not combined. Only one deck is used at a time.

Bettors bet on hand X or hand Y before any cards are dealt. Then, bettors bet again if the first card dealt to each hand does not produce a winner. Then, bettors bet again each subsequent time that each hand is dealt one additional card without producing a winner.

The winning hand can be decided after one round of betting or after multiple rounds of betting.

After winning bets are paid off and losses are collected, a new round of betting starts.

A casino derives its edge from taking a commission percentage from some or all of bettor's winning bets.

When bettors win, they win an amount equal to the amount that they bet minus any commission percentage that a casino may take.

A casino has the option of booking the bets in this game.

As an alternative to a casino booking the bettors bets in this game, a casino can choose Chemin de Fer style betting wherein different bettors alternate booking the bets and the casino takes a commission on winning bets, but does not bet against the bettors.

The deck used in this game can be comprised of any number of cards.

A six card deck would produce a fast outcome and facilitate the possibility of up to three rounds of betting. An eight card deck would produce an outcome that is almost as fast and facilitate the possibility of up to four rounds of betting.

A two card deck would produce the fastest outcome but it would only facilitate one round of betting. A twenty card deck would produce, on average, a much slower outcome than an eight card deck, but it could facilitate up to ten rounds of betting.

The size of the deck is a contributing factor in determining the average speed of this game and the average number of rounds of betting.

Each casino has the option of deciding whether it wants to emphasize more speed or more rounds of betting. Thus, each casino has the option of deciding how many cards will be in a deck that it uses.

Another contributing factor in determining the average speed of this game and the average number of rounds of betting is the number of predesignated cards that are in a deck. Increasing the number of predesignated cards in a deck, on average, results in faster outcomes and fewer rounds of betting.

Each casino has the option of deciding how many predesignated cards will be in a deck that it uses. However, before exercising its option to play this game with a deck that contains either more than one predesignated losing card or more than one predesignated winning card, a casino should carefully consider the possible game changing consequences of doing so.

For instance, if a deck contains more predesignated cards than neutral cards, the odds change to the disadvantage of one of the hands. For example, if a deck contained five predesignated losing cards and one neutral card, the hand that is dealt the first card would lose five times out of six. Similarly, if a deck contained five predesignated winning cards and one neutral card, the hand that is dealt the first card would win five times out of six.

Also for instance, if a deck contained an equal number of predesignated cards and neutral cards, each hand would have the same probability of winning. However, the even distribution of winning amongst the rounds of betting would be affected. For example, if a deck contained one predesignated card and seven neutral cards, the distribution of winning would be even. There would be a 25% probability of a hand being won in the first round, a 25% probability of a hand being won in the second round, a 25% probability of a hand being won in the third round and a 25% probability of a hand being won in the fourth round. If a deck contained four predesignated cards and four neutral cards, there would be a 78.57% probability that a hand would be won in the first round and zero probability of a hand being won in the fourth round.

Also for instance, ensuing paragraphs will describe betting mandates, free bets and side bets. Each additional predesignated card that is added to a deck changes the mathematics of betting mandates, free bets and side bets.

Because there are so many possible permutations when different numbers of predesignated cards are added to different size decks, and because examination of some of those permutations resulted in noting complications without compensating benefit, all the ensuing examples of betting mandates, free bets and side bets will be given using a deck that contains only one predesignated card.

Before deciding to use a deck that contains more than one predesignated card, it would be prudent for a casino to do a mathematical analysis to determine how odds, distribution and the appeal of the game might be affected by the specific number of predesignated cards and the specific deck size being considered.

A deck used in this game is comprised of either neutral cards and one or more predesignated losing cards or a deck is comprised of neutral cards and one or more predesignated winning cards.

Neutral cards are cards that do not determine winning or losing.

A casino has the option of playing this game with cards that have on their faces words or pictures that are suggestive of real Russian Roulette.

As an alternative option, a casino can use cards from a standard deck or cards with animals, vegetables, minerals, names, places, letters, symbols or anything on their face.

Whatever is on the face of the cards, what is required is that either the cards themselves or announced or printed rules make it clear which cards are the neutral cards and which card or cards is a predesignated card that determines the outcome of the game.

Whether or not a casino chooses to use cards with a Russian Roulette theme, this game is mathematically the same. Thus, whether or not to use cards with a Russian Roulette theme is a marketing decision that does not affect how this game is played. Similarly, whether or not to promote this game as a version of Russian Roulette is also a marketing decision that does not affect how this game is played.

When play is resumed after a hand is won, play is resumed using a full deck.

This game can be played on a betting table. For instance, but not limited to, a betting table configured like a baccarat table or a blackjack table.

This game can also be adapted to be played on the internet, over a closed circuit transmission, electronically in a casino and/or in slot machines.

A processor and a number generator and a display screen would be used as machine components of an operating system that enables the game to be played electronically.

This game is somewhat similar to craps wherein dice are rolled until a winning or losing number comes up. However, there are major differences. For instance, if you bet on pass in craps, you win if you roll a seven or an eleven on the first roll and you lose if you roll a two, three or twelve on the first roll. If you don't win or lose on the first roll, you lose if you roll a seven on a subsequent roll. Thus, seven changes from being a winning number into being a losing number. Similarly, two, three and twelve change from being losing numbers into being neutral numbers on subsequent rolls after the first roll. Similarly, eleven changes from being a winning number into being a neutral number. Similarly, if you roll a four, five, six, eight, nine or ten on the first roll, they are neutral numbers that don't affect winning or losing. After the first roll, these numbers can become winning numbers.

In contrast, in this card game, a predesignated winning card does not turn into a predesignated losing card or a neutral card if no hand wins after the first round of betting.

Furthermore, in craps, you win if a seven or eleven is thrown and you lose if a two, three or twelve is thrown. Similarly, if you bet on a point, you can win if the point, for instance a six, is thrown before a seven is thrown. In contrast, in this card game, if a deck is comprised of one or more predesignated losing cards and neutral cards, there are no winning cards. The hand a bettor bets on can't win by drawing a winning card. Similarly, if a deck is comprised of one or more predesignated winning cards and neutral cards, there are no losing cards. Thus, a hand a bettor bets on can't lose by drawing a losing card.

In craps, if you bet on pass or on a point, there are three possible outcomes, a winning number can be rolled or a losing number can be rolled or a neutral number can be rolled. In this card game, when a card is dealt to hand X or hand Y, there are only two possible outcomes because predesignated losing cards and predesignated winning cards are not in the same deck.

This card game and craps would have much greater similarity if a bettor and a dice dealer or two bettors took turns rolling the dice until one of them won by being the first one to roll a seven or an eleven. Similarly, there would be much greater congruence if a bettor and a dice dealer or two bettors took turns rolling the dice until one of them lost by being the first one to roll a two, three or twelve. Similarly, a point could be won by taking turns rolling the dice until one of the participants won by being the first one to roll a six. Similarly, a point could be lost by taking turns until one of the participants lost by being the first one to roll a seven.

Similarly, in craps, a bet on two sixes in one roll is comparable to playing a card game with thirty-five predesignated losing cards and one predesignated winning card and no neutral cards. Again, what would be more congruent is if turns were taken by two participants rolling the dice until one participant won by rolling two sixes.

Similarly, a field bet in craps on two, three, four, nine, ten, eleven and twelve is comparable to playing a card game with a deck composed of sixteen predesignated winning cards, twenty predesignated losing cards and no neutral cards. Again, what would be more congruent is if turns were taken rolling the dice until one of the participants won by being the first one to roll a two, three, four, nine, ten, eleven or twelve.

This game is also somewhat similar to faro. However, there are major differences.

In this game bettors bet on one of two hands. In faro, bettors bet on one of thirteen cards.

Even if you think of it as there being two hands in faro, with the first card being dealt to the dealer's hand and the second card being dealt to the player's hand, there are still major differences between this game and faro.

In this game, a hand is won as soon as one of the hands is dealt a predesignated card. Thus, in this game a hand can be won after only one card is dealt to one of the two hands. In faro, winning does not result from only one card being dealt. In faro, at least two cards are dealt to decide winning and losing.

For instance, in faro, even if a winning card is dealt to the dealers hand, the bet isn't decided. Another card is dealt to the players hand to determine if the winning hand changes from being a winning hand into being a tied hand.

In contrast with faro, this game has no ties.

In this game a casino derives its edge from taking a commission on some or all of bettors' winning bets. In faro, the banker takes an edge from confiscating 50% of tied bets.

Real Russian Roulette can involve multiple rounds of each participant taking a turn. As successive rounds bring the exercise closer to conclusion, tension and excitement mount more and more. An object of this card game is to mimic some of that tension and excitement by using a betting method that can increase the financial risk of betting on a hand more and more and also increase the potential for financial reward more and more.

Poker has multiple rounds of betting that can raise the stakes more and more. However, in poker, bettors are motivated to increase their bets because they think that the cards or card just dealt improves their chance of winning or because they think that they can bluff their way to victory.

In this game, a card dealt in a preceding round does not change a bettor's probability of winning or provide any reason to attempt to bluff. Therefore, this game requires a regulating mechanism to get bettors to bet substantial amounts in each new round of betting that takes place before a hand is won.

The method that is used in this game to regulate betting in a hand is comprised of using a bettor's first bet in a hand as the basis for mandating the monetary value of future bets that the bettor makes in the hand.

A bettor's first bet in a hand, before any cards are dealt, can be any amount within the minimum and maximum amounts set by a casino for the table that the better is playing at. Within the minimum and maximum rules, a bettor's first bet is his or her choice. After the first bet, the bettor is locked in by whatever mandate a casino chooses until the hand is won or lost.

A casino has the option of mandating that each new bet that a bettor makes in a hand must be larger than the immediately preceding bet that the better made in the hand. For instance, but not limited to, if a bettor's first bet in a hand is M, the bettor could be required to bet and additional 2M if there is a second round of betting and an additional 3M if there is a third round of betting. Thus, with one to six cards dealt from a six card deck containing one predesignated card, the bettor could win or lose M, 3M or 6M depending on which round a bet is won or lost in.

Also for instance, but not limited to, if a bettor's first bet is M, the bettor could be required to bet an additional 2M if there is a second round of betting and an additional 3M if there is a third round of betting and an additional 4M if there is a fourth round of betting. Thus, with one to eight cards dealt from an eight card deck containing one predesignated card, the bettor could win or lose M, 3M, 6M or 10M.

M represents monetary value of any sort. For instance, but not limited to, money or chips.

If the deck is comprised of four cards, and there is no winner after the first round, then only one larger betting increase can be mandated. If the deck is comprised of ten cards or more, then more than three larger and larger betting increases can be mandated.

As an alternative to mandating larger and larger betting increases, a casino has the option of mandating serial betting increases. For instance, but not limited to, using a six card deck containing one predesignated card, if a bettor's first bet is M, the bettor could be required to bet an additional M if there is a second round of betting and an additional M if there is a third round of betting. Thus, the bettor could win or lose M, 2M or 3M, depending on which round a bet is won or lost in. Also for instance, but not limited to, using an eight card deck containing one predesignated card, the bettor could win or lose M, 2M, 3M or 4M depending on which round a bet is won or lost in.

Serial betting increases can be mandated if the deck that is used to play this game contains four or more cards.

A casino also has the option of mandating a combination of one or more serial betting increases and one or more larger and larger betting increases. For instance, but not limited to, M, M, 2M, 3M.

A casino also has the option of mandating fractional betting increases. For instance, but not limited to, M, 1.5M, 1.5M or M, 1.5M, 2.5M or M, 0.5M, 0.5M.

All of the mandates that have been described or mentioned in preceding paragraphs are some of many possible mandates.

A casino has the option of deciding the specifics of any mandate that it requires bettors to adhere to.

A casino has the option of employing different mandates at different tables in the casino. One reason for doing so would be to offer bettors wilder and tamer versions of this game for the purpose of appealing to different segments of the market.

A casino also has the option of alternating mandates at a betting table in the same way that different variations of poker can be alternated at a betting table after a hand is won.

Bettors should be aware or made aware of the table rules regarding a mandate before they begin betting.

If a bettor runs out of money or decides, for any reason, not to comply with the mandate that a casino has chosen, the bettor forfeits the bet or bets that the bettor has already made in a hand that has not yet been won or lost.

In this game, a casino derives its edge from taking a percentage commission from some or all of bettor's winning bets.

Because of the structure of this game, a casino can, if it chooses to do so, offer bettors multiple free bets without lowering the casino's average edge on this game.

A method for giving bettors multiple free bets with no casino commission without lowering a casino's average edge is comprised of compensating for the free bets by raising the edge on other bets in the game that bettors can't avoid if they keep playing the game.

For instance, but not limited to, using an eight card deck, with mandated bets of M, 2M, 3M and 4M, if a casino wanted to offer bettors a 1.25% casino edge to make the game competitive with baccarat, the casino could offer bettors, who win on any of the first three rounds of betting, commission free wins and charge bettors who win on the fourth round a 5% commission. Thus, 75% of the time, when bettors win M, 3M or 6M, they would pay no commission. The only time winning bettors would pay a commission is when they win 10M on the fourth round.

In the example given in the preceding paragraph, bettors can win M, 3M, 6M or 10M, depending on which round they win in. On average, bettors win 50% of the time. Thus, a 5% commission is equivalent to a 2.5% casino edge. If the first three rounds are commission free, bettors are paying commission on 10M instead of 20M. Thus, a 2.5% casino edge is reduced by half to 1.25%.

Also for instance, but not limited to, using an eight card deck, with mandated bets of M, 2M, 3M and 4M, if a casino wanted to offer bettors a 2% casino edge, the casino could offer bettors who win on any of the first two rounds of betting, commission free wins and charge bettors who win on the third or fourth round a 5% commission. Thus, 50% of the time, when bettors win M or 3M, they would pay no commission. The only times winning bettors would pay a commission is when they win 6M on the third round or 10M on the fourth round.

In the example given in the preceding paragraph, if the first two rounds are commission free, bettors are paying commission on 16M instead of 20M. Thus, a 2.5% casino edge is reduced by 20% to 2%.

Also for instance, but not limited to, using a six card deck, with mandated bets of M, 2M and 3M, if a casino wanted to offer bettors a 1.20% casino edge, the casino could offer bettors who win on the first or second rounds of betting a commission free win and charge bettors who win on the third round of betting a 4% commission.

In the example in the preceding paragraph, bettors win M, 3M or 6M, depending on which round they win in. Thus, making the first two rounds commission free lowers a casino's edge by 40% because commission is being taken on 6M instead of 10M. Since a casino wins 50% of the time, a 4% commission equals a 2% edge on the game. When you lower the 2% edge by 40%, you get an edge of 1.20%.

Also for instance, but not limited to, using a six card deck with mandated bets of M, 2M and 3M, if a casino wanted to offer bettors a 2% casino edge, the casino's commission would have to be fractional. However, the casino could offer bettors a 2.10% casino edge by making winning on the first two rounds commission free and charging third round winners a 7% commission. Also, the casino could offer bettors a 1.80% casino edge by making the first two rounds commission free and charging third round winners a 6% commission.

In the examples given in the preceding paragraph, the casino edge is arrived at by dividing the casino commission in half and subtracting the 40% of monetary value that is commission free.

Also, for instance, but not limited to, using a six card deck with a mandate of M, M and M, a casino can offer a 1.25% casino edge by making the first round commission free and charging bettors who win on the second or third rounds a 3% commission.

In the example given in the preceding paragraph, bettors can win M, 2M or 3M depending on which round they win in. If the first round is commission free, that lowers a casinos edge by one sixth because the casino is taking a commission on 5M instead of 6M. Thus, a 3% commission becomes a 1.5% edge which is lowered by one sixth to 1.25%.

Also for instance, but not limited to, using a six card deck with a mandate of M, M and M, a casino can offer bettors a 2% casino edge by making the first two rounds commission free and charging bettors who win 3M on the third round an 8% commission.

In the example given in the preceding paragraph, if the first two rounds are commission free, the casino is taking a commission on 3M instead of 6M. Thus, an 8% commission becomes a 4% edge which is lowered to 2% because the casino is taking a commission on only half of bettor's winnings.

When a casino offers bettors multiple free bets, the casino can adjust its edge to a desired amount by adjusting the casino's commission percentage in conjunction with adjusting the number of M that are commission free.

When a casino offers bettors multiple free bets, the casino has the option of choosing the edge that it takes. Thus, a casino can choose an edge that is higher than the 2.10% edge mentioned in a preceding paragraph or choose an edge that is lower than the 1.20% edge mentioned in a preceding paragraph or choose an edge that is between 1.20% and 2.10%.

A casino has the option of offering free bets using other size decks than six or eight card decks.

A casino has the option of offering free bets in conjunction with mandates other than those that were specifically described in preceding paragraphs.

If only the first round of betting is offered commission free, a casino is still offering multiple free bets because in the first round bettors are being offered free bets on hand X and hand Y.

In craps, casinos offer bettors, who bet on pass, the option of making a free bet on the point. This free bet appeals to bettors. However, it has the down side of lowering a casino's average edge.

In craps, if a casino tried to compensate for a free bet by raising its edge on one or more other craps bets, bettors could easily avoid the bet or bets that have a raised edge. They could keep playing craps and choose to only make bets that didn't have a raised edge. For instance, they could keep betting on pass and keep taking advantage of the free bet on the point.

In contrast, in this card game bettors who keep playing the game can't avoid the bets that have an increased edge.

As an alternative to offering free bets, a casino has the option of taking a commission on every winning bet that bettors make. For instance, but not limited to, regardless of the size of the deck and regardless of the mandate, if a casino wanted to offer bettors a 1.25% casino edge, the casino would take a 2.50% commission on all bettor's winning bets. Also, for instance, but not limited to, if a casino wanted to offer bettors a 2% casino edge, the casino would take a 4% commission on all bettor's winning bets.

Regardless of the size of the deck and regardless of which mandate is employed, if a casino takes a commission on every winning bet that bettors make, the casino's edge will be half the commission. Thus, a 5% commission equals a 2.50% edge, a 6% commission equals a 3% edge and a 3% commission equals a 1.50% edge. In this manner, a casino has the option of making its edge as high or as low as it wants.

Whether a casino offers free bets or takes a commission on every winning bet, a casino has the option of offering different edges at different tables in the casino. One purpose for this would be to appeal to different segments of the market. For instance, for the purpose of giving whales a better deal than average bettors.

This game includes optional side bets.

If side bets are made, bettors make them before any cards are dealt.

Side bets are comprised of bettors betting on which round hand X or hand Y will win in. For instance, but not limited to, bettors can bet that hand X will win in the second round of betting. If hand X loses or if hand X wins in any round other than the second round, the bettor loses. The only time that the bettor wins is if hand X wins in the second round.

If this game is played with a six card deck containing one predesignated card, the odds against hand X winning in the second round are 5 to 1. If this game is played with an eight card deck containing one predesignated card, the odds against hand X winning on the second round are 7 to 1.

Regardless of the size of the deck, if the deck contains one predesignated card, the odds against hand X or hand Y winning on any particular round are the number of neutral cards to 1.

Unlike the rest of this game wherein bettors win an amount equal to the amount that they bet, bettors who win a side bet will win an amount equal to more than the amount that they bet.

A casino's edge on side bets is taken in the form of a commission on winning bets. This commission can be in the form of an announced commission or in the form of paying winners less than the correct odds. For instance, but not limited to, if the correct odds of a side bet are 5 to 1, paying winning bettors 4.50 to 1 is mathematically the same as taking a 10% commission on winning bets.

This game is envisioned as being adaptable for home use.

While this game has been described with respect to various embodiments thereof, it will be understood by those of ordinary skill in the art that other variations and modifications can be effected within the scope and spirit of this game.

Brief description of the drawings. Two flow charts are submitted. The flow chart labeled FIG. 1, on pages 1, 2 and 3, shows how the game is played using three variables that are described in this specification. The flow chart labeled FIG. 2, on pages 4, 5 and 6, shows how an optional side bet that is described in this specification plays out.

Figure 1A:
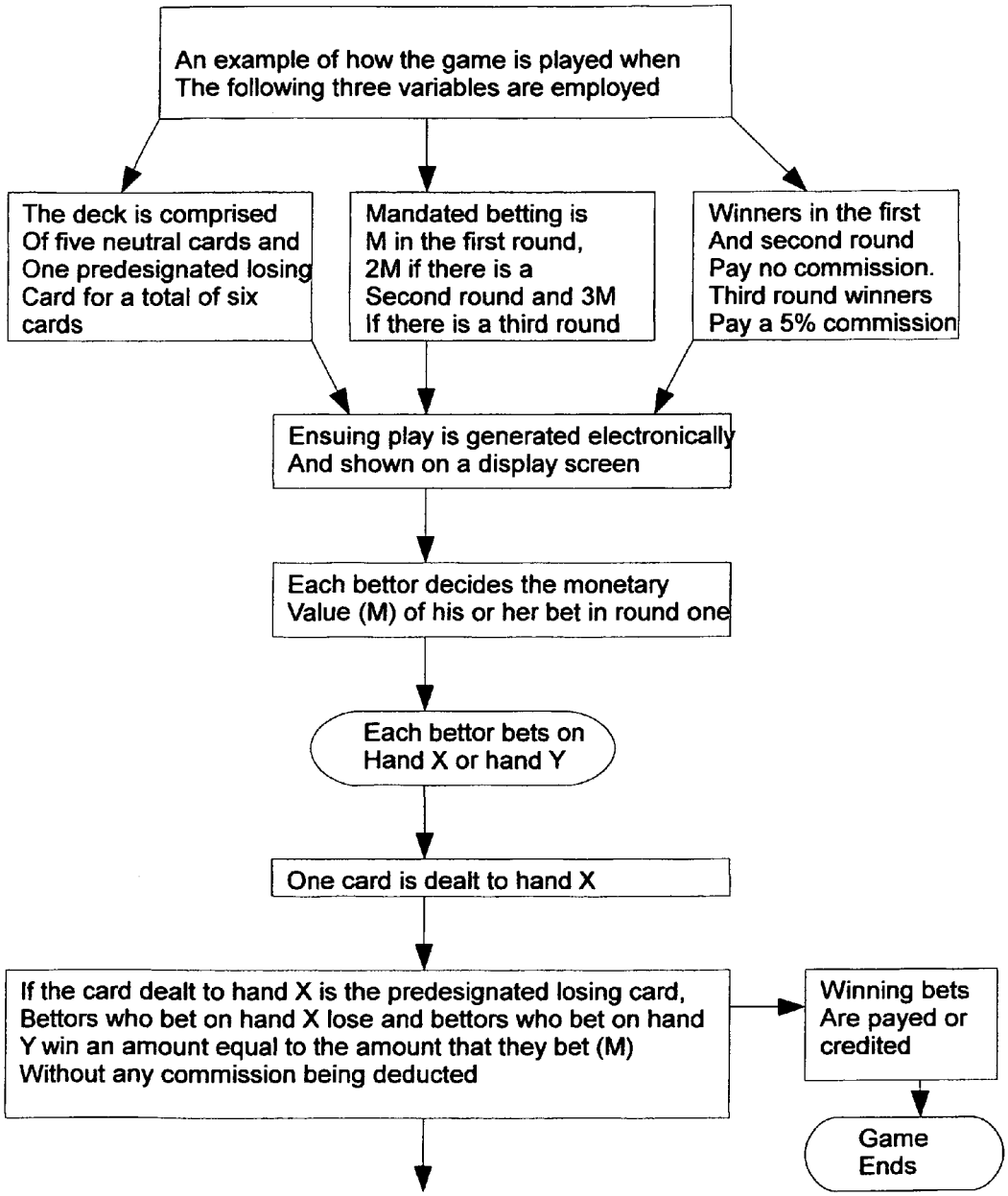
FIG. 1A shows how the game can start.
Figure 1B:
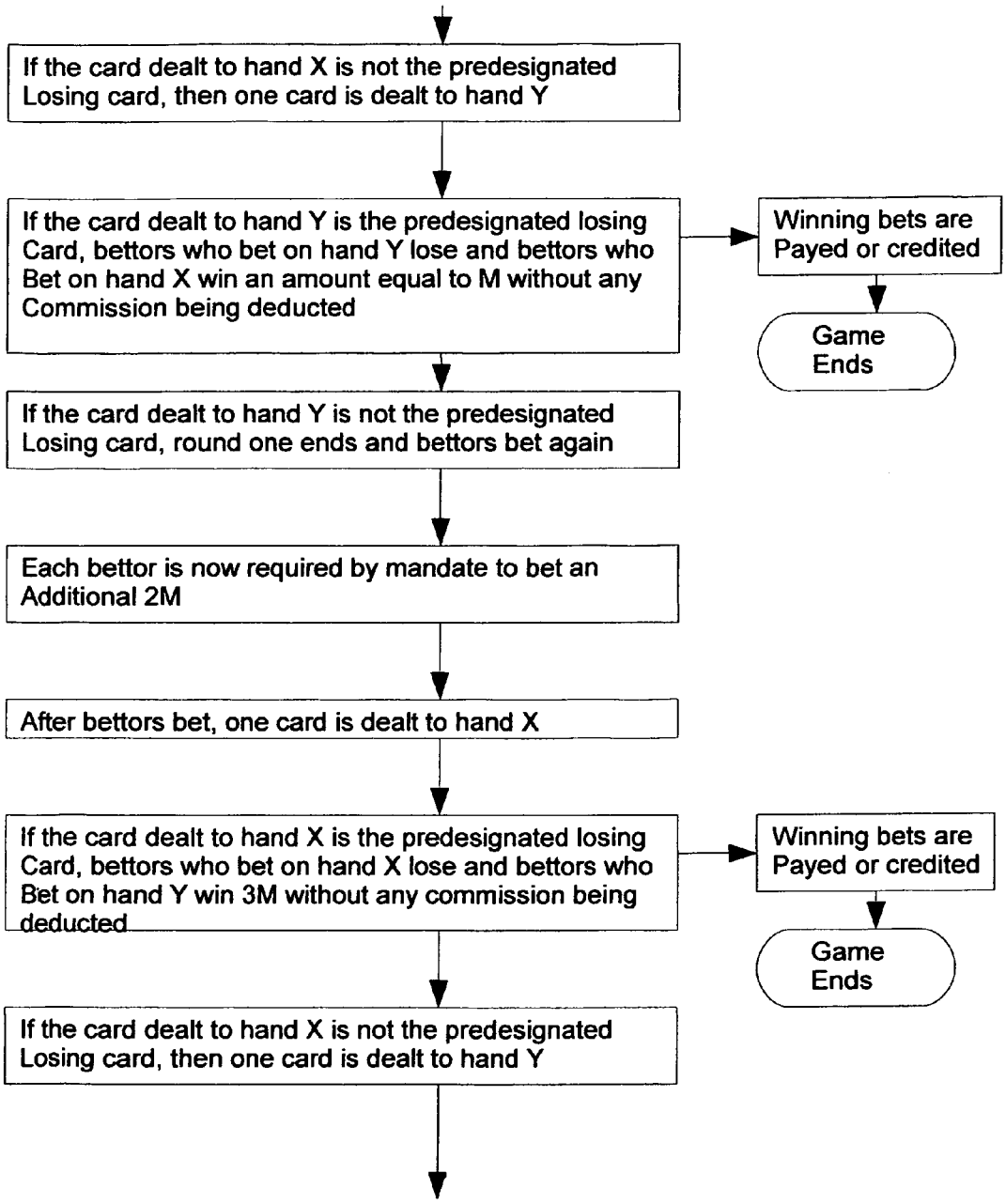
FIG. 1B shows how the game can continue.
Figure 1C:
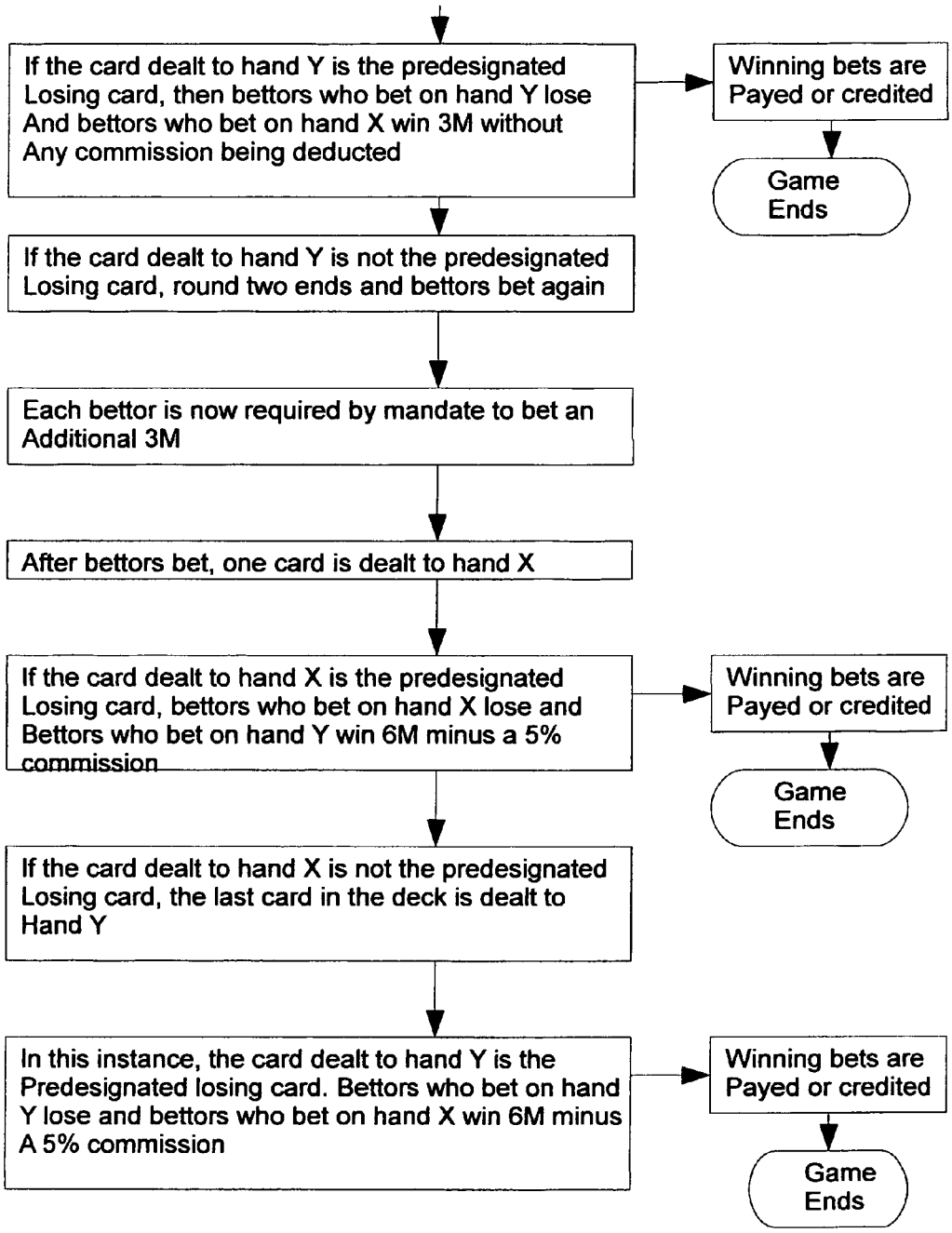
FIG. 1C shows how the game can continue to its end.
Figure 2A:
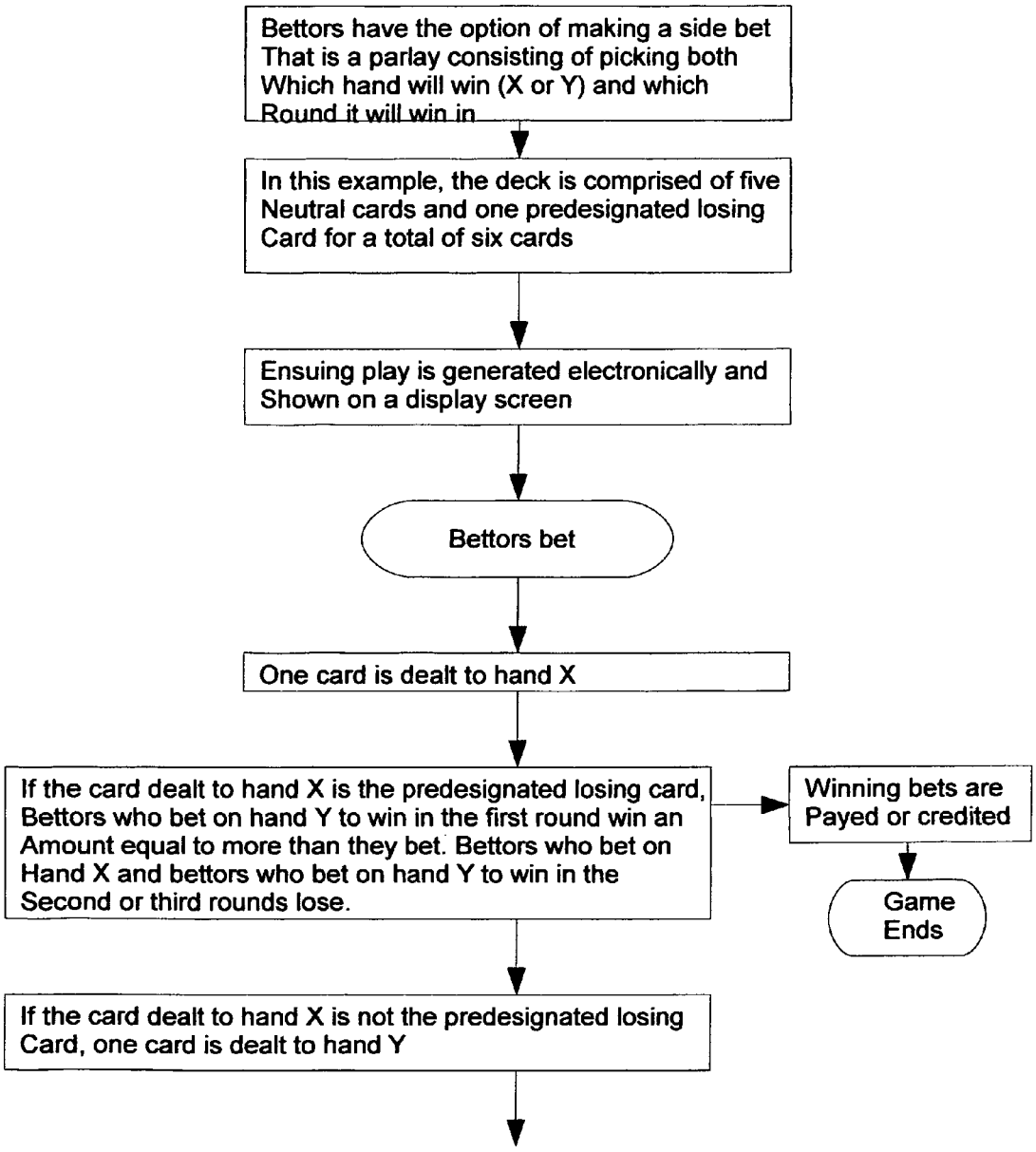
FIG. 2A shows how a side bet can start to play out.
Figure 2B:
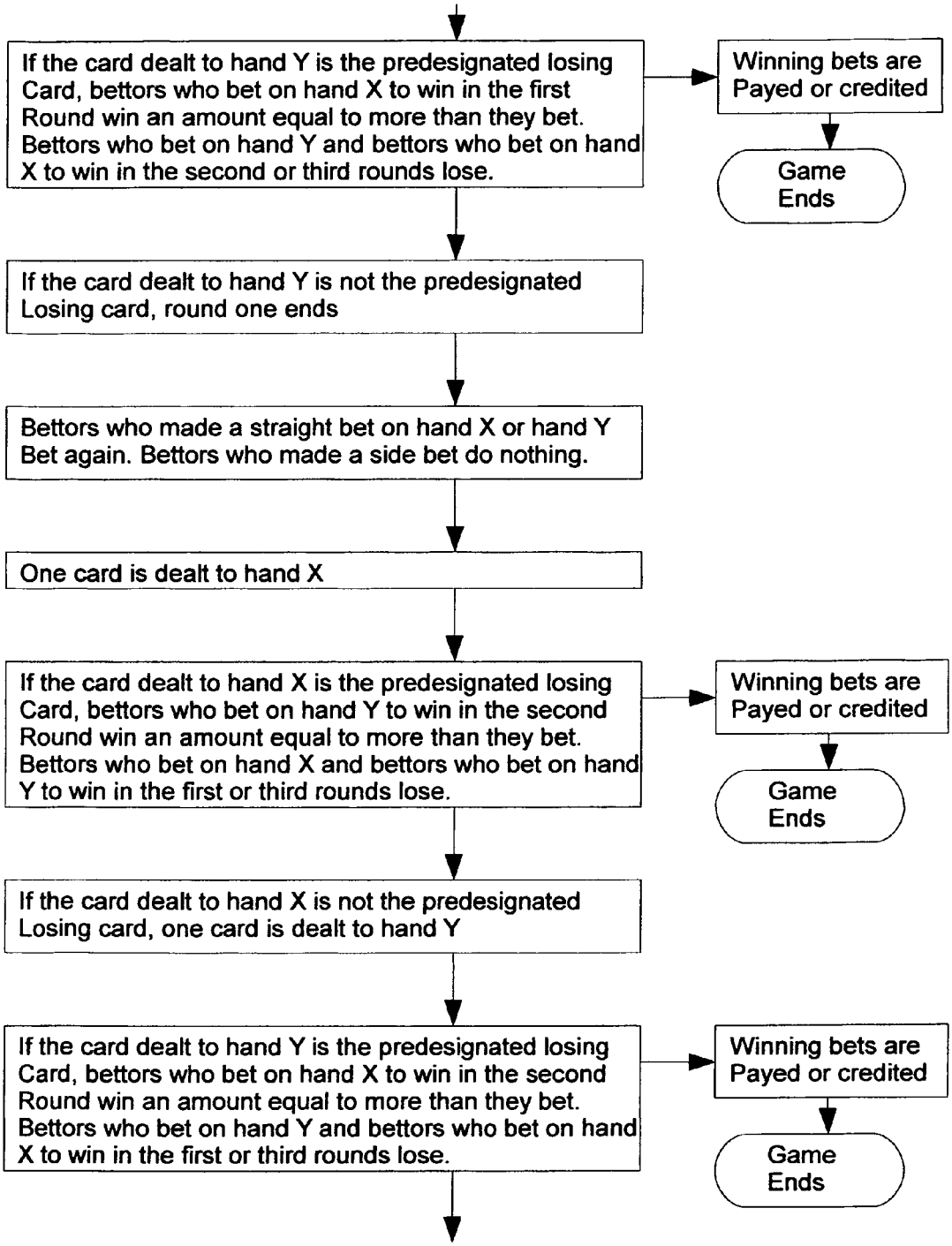
FIG. 2B shows how said side bet can continue to play out.
Figure 2C:
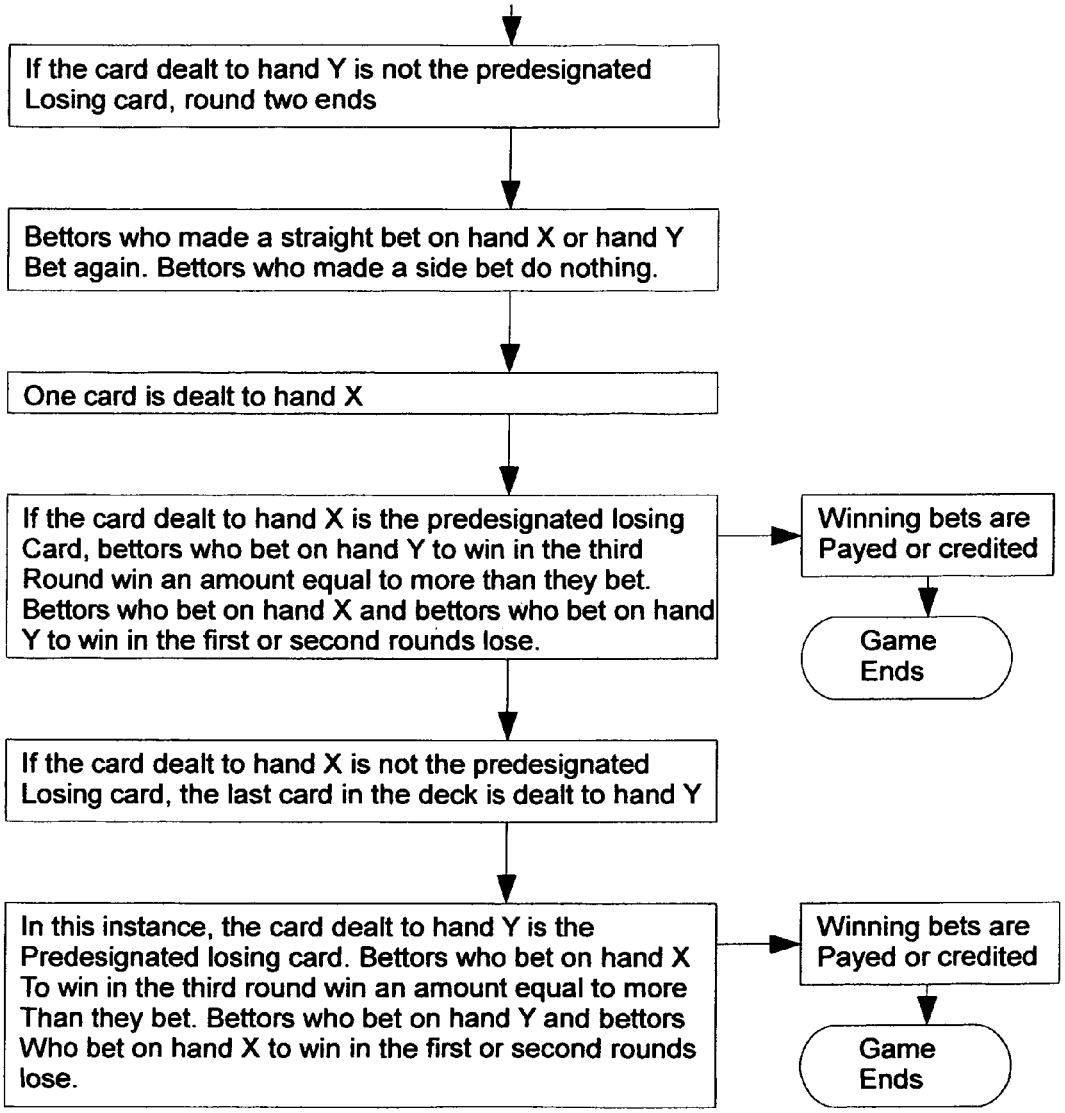
FIG. 2C shows how said side bet can continue to its end.

I claim:

1. A method for determining which hand of a wagering card game is the winning hand comprising dealing alternately one card from a full deck containing substantially fewer than 52 cards to hand X and hand Y until one of the two hands is dealt a predesignated card that by itself decides winning and losing using a processor and a number generator and a display screen as machine components of an operating system that enables the game to be played electronically, wherein dealing a predesignated card that by itself decide winning and losing to hand X or hand Y stops play as soon as it is dealt; wherein the deck consists of neutral cards that have no value and do not determine winning and losing, and at least one predesignated card that by itself decides winning and losing.

2. The method of claim 1, wherein a predesignated card that by itself decides winning and must be dealt before winning and losing can occur.

3. The method of claim 1, wherein hand X or hand Y can win after only one card has been dealt to one of the two hands.

4. The method of claim 1, wherein a full deck contains substantially fewer cards than a standard 52 card deck thereby facilitating substantially faster outcomes than would occur if a 52 card deck is used thereby facilitating substantially more outcomes per hour in commercial use.

5. The method of claim 1, wherein regardless of the number of bettors only two hands are dealt thereby facilitating faster outcomes than would occur if more than two hands are dealt thereby facilitating more outcomes per hour in commercial use.

6. The method of claim 1, wherein bettors have the option of betting on hand X or hand Y.

7. The method of claim 1, wherein bettors bet on hand X or hand Y before any cards are dealt and then bet again if the first card dealt to each hand does not produce a winner and then bet again each subsequent time that each hand is dealt one additional card without producing a winner.

8. The method of claim 7, where in the monetary value of a bettors first bet in a hand is used as a basis for mandating the monetary value of future bets that the bettor makes in said hand.

9. The method of claim 1, wherein a casino has the option of taking a commission on some or all of bettors winning bets.

10. The method of claim 9, wherein a casino has the option of offering bettors multiple commission free bets without lowering the casinos average edge on the game.

11. The method of claim 1, wherein winning bettors win an amount equal to the amount that they bet minus any commission that a casino may take.

12. The method of claim 1, wherein bettors can make an optional side bet comprising picking both which hand will win and which round it will win in.

13. The method of claim 12, wherein bettors who win a side bet will win an amount equal to more than the amount that they bet.

* * * * *